US008663028B2

(12) United States Patent
Nakano

(10) Patent No.: US 8,663,028 B2
(45) Date of Patent: Mar. 4, 2014

(54) GOLF CLUB HEAD

(75) Inventor: Takashi Nakano, Kobe (JP)

(73) Assignee: SRI Sports Limited, Kobe (JP)

( * ) Notice: Subject to any disclaimer, the term of this patent is extended or adjusted under 35 U.S.C. 154(b) by 49 days.

(21) Appl. No.: 12/845,184

(22) Filed: Jul. 28, 2010

(65) Prior Publication Data

US 2011/0028235 A1 Feb. 3, 2011

(30) Foreign Application Priority Data

Jul. 29, 2009 (JP) ..... 2009-176840

(51) Int. Cl.
*A63B 53/00* (2006.01)

(52) U.S. Cl.
USPC ..... 473/332; 473/329; 473/349

(58) Field of Classification Search
USPC ..... 473/305, 324, 329, 332, 348, 349, 350
See application file for complete search history.

(56) References Cited

U.S. PATENT DOCUMENTS

| | | | | |
|---|---|---|---|---|
| 5,628,697 | A * | 5/1997 | Gamble | 473/326 |
| 5,890,973 | A * | 4/1999 | Gamble | 473/326 |
| 6,062,988 | A * | 5/2000 | Yamamoto | 473/324 |
| 6,962,538 | B2 * | 11/2005 | Roach et al. | 473/332 |
| 7,303,486 | B2 * | 12/2007 | Imamoto | 473/332 |
| 7,316,623 | B2 * | 1/2008 | Imamoto | 473/332 |
| 7,371,190 | B2 * | 5/2008 | Gilbert et al. | 473/332 |
| 7,481,719 | B2 * | 1/2009 | Imamoto | 473/332 |
| 7,559,850 | B2 * | 7/2009 | Gilbert et al. | 473/290 |
| 7,713,141 | B2 * | 5/2010 | Yamamoto | 473/332 |
| 2004/0043830 | A1 * | 3/2004 | Imamoto | 473/332 |
| 2004/0067799 | A1 * | 4/2004 | Yamamoto | 473/324 |
| 2005/0096149 | A1 * | 5/2005 | Chen | 473/324 |
| 2005/0119066 | A1 * | 6/2005 | Stites et al. | 473/329 |
| 2005/0192116 | A1 * | 9/2005 | Imamoto | 473/329 |
| 2005/0239572 | A1 * | 10/2005 | Roach et al. | 473/332 |
| 2005/0266932 | A1 * | 12/2005 | Roach et al. | 473/332 |
| 2005/0277485 | A1 * | 12/2005 | Hou et al. | 473/332 |
| 2006/0068933 | A1 * | 3/2006 | Dewanjee et al. | 473/329 |
| 2006/0234811 | A1 * | 10/2006 | Gilbert et al. | 473/349 |
| 2007/0249431 | A1 * | 10/2007 | Lin | 473/324 |
| 2007/0281796 | A1 * | 12/2007 | Gilbert et al. | 473/332 |
| 2008/0020860 | A1 * | 1/2008 | Imamoto | 473/332 |
| 2008/0032815 | A1 * | 2/2008 | Yamamoto | 473/332 |

(Continued)

FOREIGN PATENT DOCUMENTS

| | | |
|---|---|---|
| JP | 7-213656 A | 8/1995 |
| JP | 9-239077 A | 9/1997 |

*Primary Examiner* — Gene Kim
*Assistant Examiner* — John E Simms, Jr.
(74) *Attorney, Agent, or Firm* — Birch, Stewart, Kolasch & Birch, LLP

(57) ABSTRACT

A golf club head having a good feel of hitting a ball, comprising a head body 1A having a face 2 for hitting a ball on a front side of the head body and having at least one recess portion 10 in an outer surface 1S thereof except the face 2, and at least one vibration absorbing member made of a viscoelastic material and disposed in the recess portion 10, the recess portion 10 including a bottom surface 10*a* and a sidewall surface 10*b* extending from the bottom surface 10*a* to the outer surface 1S, and the vibration absorbing member 11 being fixed to the bottom surface 10*a* to provide a free vibration portion 11A extending up to a position corresponding to the outer surface 1S of the head body 1A without coming into contact with the sidewall surface 10*b* of the recess portion 10.

15 Claims, 8 Drawing Sheets

(56) References Cited * cited by examiner

U.S. PATENT DOCUMENTS

| | | | | |
|---|---|---|---|---|
| 2009/0062032 | A1* | 3/2009 | Boyd et al. | 473/338 |
| 2009/0118033 | A1* | 5/2009 | Nakamura | 473/332 |
| 2010/0144460 | A1* | 6/2010 | Gilbert et al. | 473/332 |

GOLF CLUB HEAD

BACKGROUND OF THE INVENTION

The present invention relates to a golf club head having an improved feel of hitting a golf ball.

In order to improve the ball-hitting feel of metallic golf club heads, it is proposed to attach a vibration absorber made of a rubber or a resin to a back face or the like of the golf club heads, as disclosed in JP-A-7-213656 and JP-A-9-239077. It is demanded to further improve a vibration absorbing effect of the vibration absorber.

It is an object of the present invention to provide a golf club head, particularly an iron-type golf club head, having an improved feel of hitting a golf ball.

This and other objects of the present invention will become apparent from the description hereinafter.

SUMMARY OF THE INVENTION

In known golf club heads, the vibration absorber is tightly inserted into a recess portion or the like formed in the back face. However, it has been found that a vibration absorbing effect of the vibration absorber is not sufficiently exhibited when the vibration absorber is disposed to a golf club head in a tight fitting state. Further, it has been found that the vibration absorbing effect is improved by disposing at least one vibration absorbing member made of a viscoelastic material in a recess or recesses formed in an outer surface of a head body of a golf club head in such a manner that the vibration absorbing member is firmly fixed to a bottom surface of the recess so that the vibration absorbing member has a free vibration portion extending up to the other end of the member located at a position corresponding to the outer surface of the head body without coming into contact with a sidewall surface of the recess.

In accordance with the present invention, there is provided a golf club head comprising a head body having a face for hitting a ball on a front side of the head body, and at least one vibration absorbing member made of a viscoelastic material, said head body having at least one recess portion for inserting said vibration absorbing member in an outer surface of said head body except said face, said recess portion including a bottom surface and a sidewall surface extending from said bottom surface to said outer surface, and said vibration absorbing member being fixed to said bottom surface to have a free vibration portion extending up to the other end of said member located at a position corresponding to said outer surface of said head body without coming into contact with said sidewall surface of said recess portion.

Usually, said head body has one or two recess portions.

Since the golf club head of the present invention has a vibration absorbing member made of a viscoelastic material in a recess portion formed in the head body, vibration of the head body generating on hitting a ball is absorbed by the absorbing member to give a soft feel of hitting a ball. Moreover, since only one end or one end portion of the vibration absorbing member is firmly fixed to the bottom surface of the recess portion to provide a free vibration portion extending up to the outer surface position of the head without coming into contact with the sidewall surface of the recess portion, a vibration of the head body transmitted from the bottom side of the recess portion can be efficiently absorbed, thus remarkably improving the feel of hitting a ball.

BRIEF DESCRIPTION OF THE DRAWINGS

FIG. 5A is a partial enlarged end view at a position corresponding to the line A-A of FIG. 2, and FIG. 5B is a partial back view viewed from "B" in FIG. 5A;

FIG. 6A is a partial enlarged end view at a position corresponding to the line A-A of FIG. 2, and FIG. 6B is a partial back view viewed from "B" in FIG. 6A;

DETAILED DESCRIPTION OF THE INVENTION

An embodiment of the present invention will now be explained with reference to the accompanying drawings.

Figure 1:
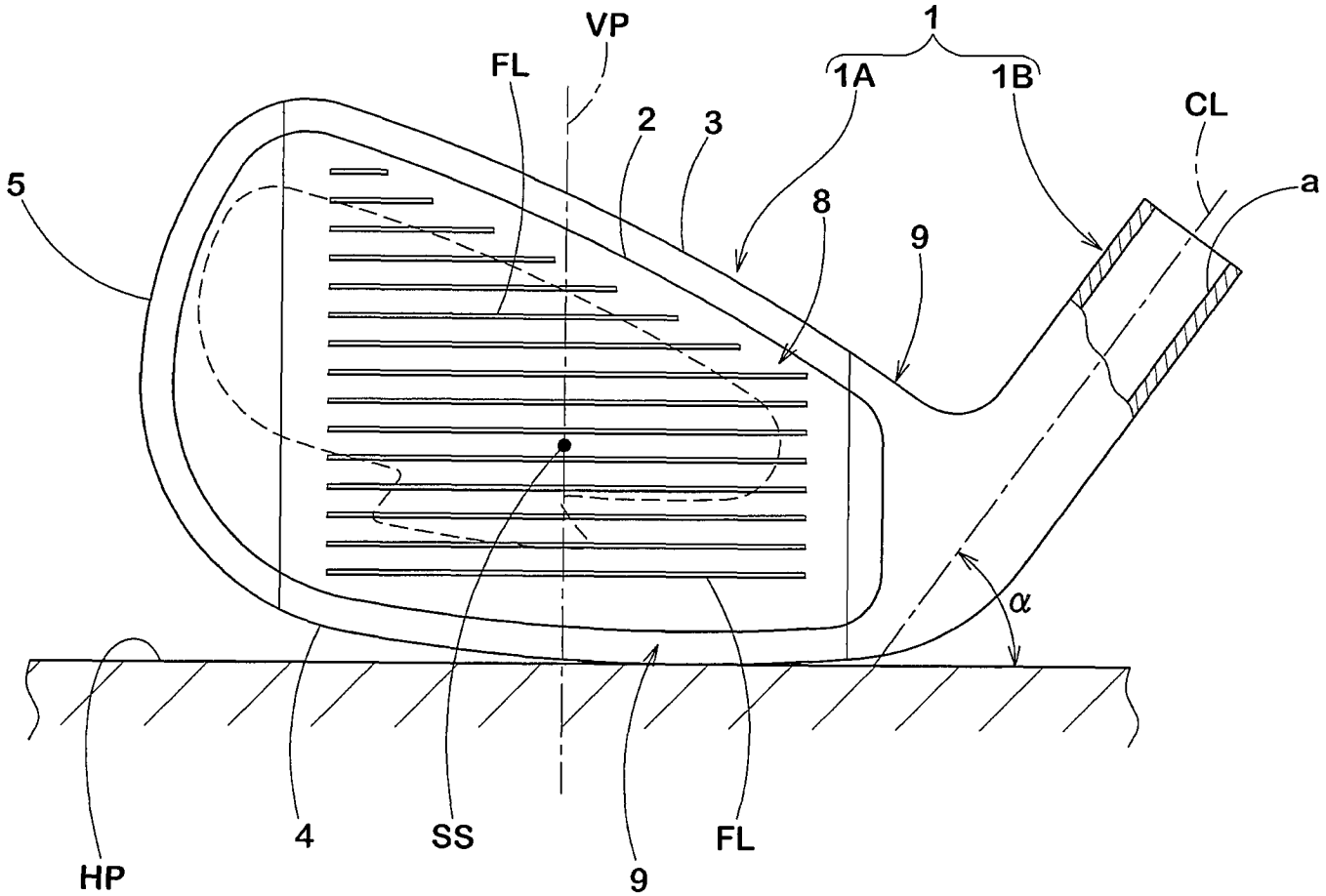
FIG. 1 is a front view of an iron-type golf club head in the standard state according to an embodiment of the present invention.
Figure 2:
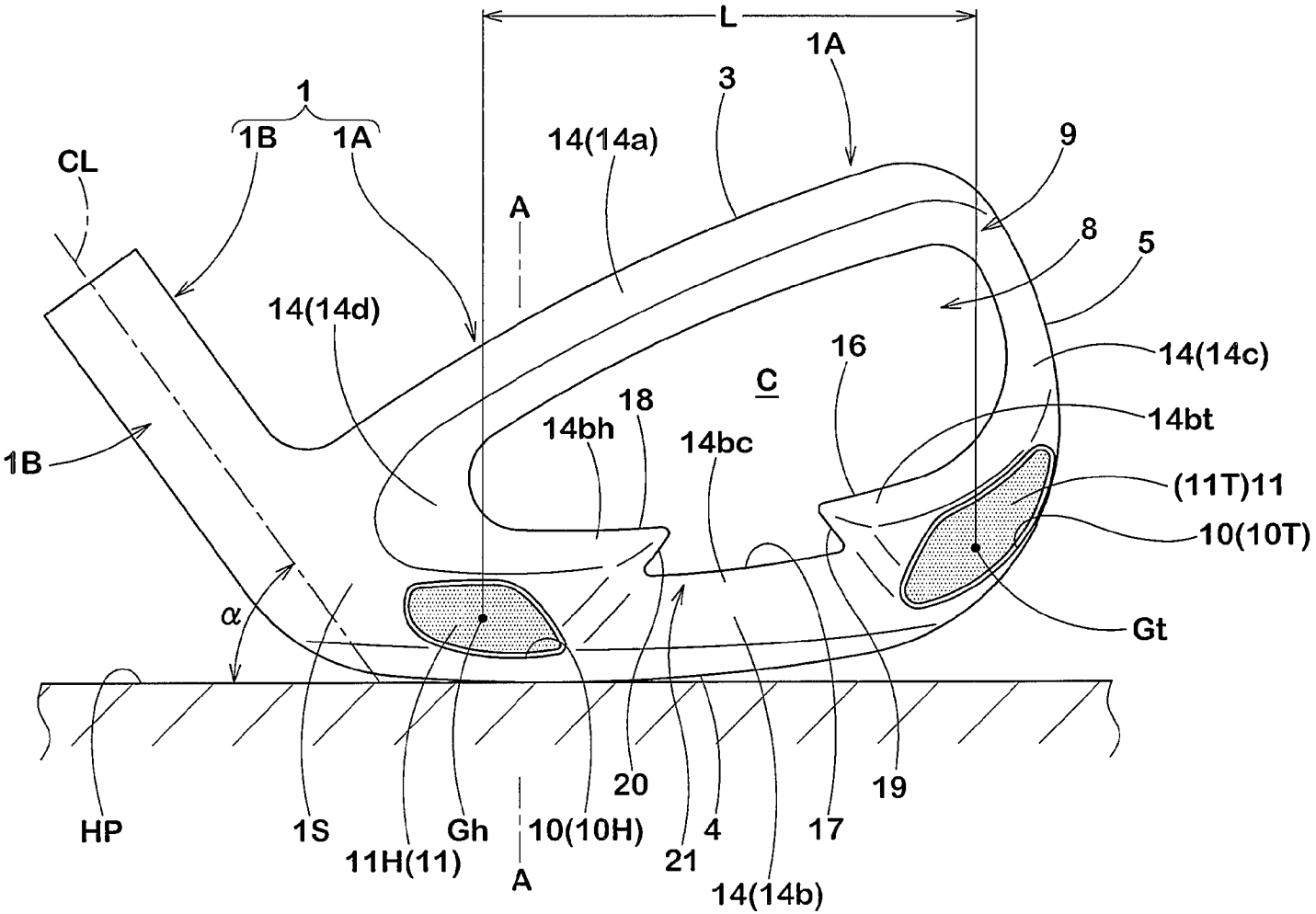
FIG. 2 is a back view of the club head of FIG. 1.
Figure 3:
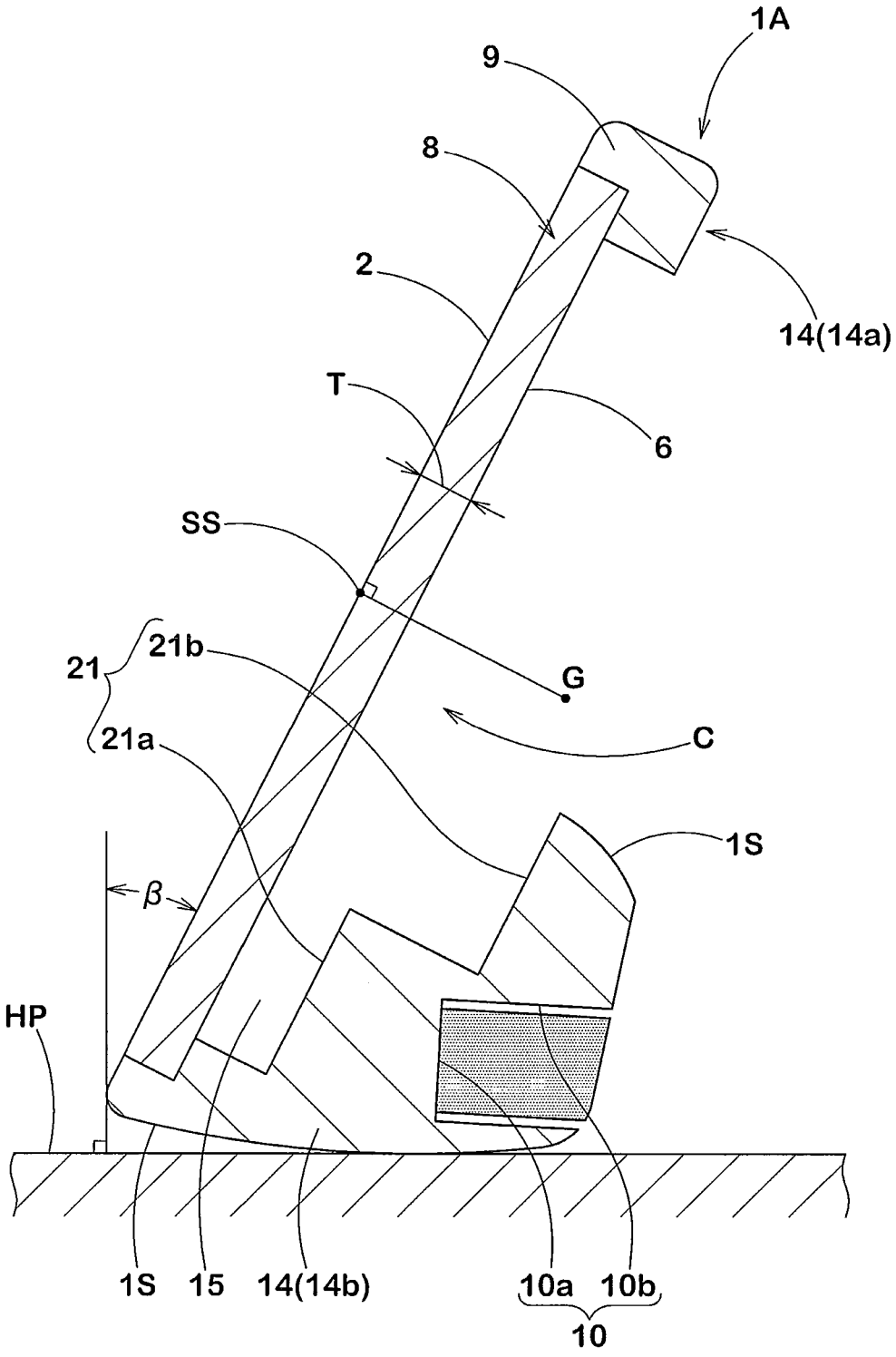
FIG. 3 is an end view along the line A-A of FIG. 2.

FIGS. 1 to 3 show a golf club head 1 in a standard state according to an embodiment of the present invention. The term "standard state" as used herein denotes the state that the club head 1 is placed on a horizontal plane HP with keeping prescribed lie angle $\alpha$ and loft angle $\beta$ (shown in FIGS. 1 and 3). The golf club head 1 shown in the drawings is placed in the standard state unless otherwise noted.

The golf club head 1 shown in this embodiment is an iron-type golf club head, and it includes a head body 1A having a face 2 for hitting a ball on a front side of the head body, and a hosel portion 1B continuously provided on a heel side of the head body 1A.

As shown in FIGS. 1 to 3, the head body 1A includes the face 2, a top surface 3 which is continuous with an upper edge of the face 2 and forms an upper portion of the head 1, a sole surface 4 which is continuous with a lower edge of the face 2 and forms a bottom surface of the head 1, a toe surface 5 which is smoothly curved between the top surface 3 and the sole surface 4 to connect them on the toe side, and a back face 6 which forms a surface on the side opposite to the face 2.

In the golf club head 1 shown in this embodiment, a hosel portion 1B having a hole "a" for inserting a shaft (now shown) is integrally formed with the head body 1A on the heel side of the head body 1A. In the case that no club shaft is attached, the lie angle $\alpha$ of the head 1 can be determined based on a center line CL of the shaft inserting hole "a".

The golf club head 1 in this embodiment is preferably formed from, as shown in FIG. 3, a plate-like face member 8 made of a metallic material including at least a part of the face 2 (in case of this embodiment, a main part of the face 2), and a face-receiving member 9 made of a metallic material for holding or supporting the face member 8 in which the head body 1A and the hosel portion 1B are integrally formed.

The metallic materials for the face member 8 and the face-receiving member 9 are not particularly limited, and various metals such as titanium, titanium alloy, aluminum alloy, stainless steel and soft iron can be used. In particular, a metallic material having a high specific strength and a high repulsion property is preferred for the face member 8, and a metallic material having a specific gravity higher than that of the face member 8 is preferred for the face-receiving member 9.

In this embodiment shown in the drawings, the face member 8 is prepared from a titanium alloy, and the face-receiving member 9 is prepared by casting from a stainless steel having a higher specific gravity than that of the metallic material of the face member 8, whereby a larger weight is allocated to a peripheral portion around the face member 8 to provide a head 1 having a large moment of inertia and a large sweet spot area.

Preferably, the face-receiving member 9 is prepared by casting to integrally form the respective portions into a body, whereby the productivity can be improved.

It goes without saying that a combination of the metallic material of face member 8 and the metallic material of face-receiving member 9 can be variously changed. The face member 8 and the face-receiving member 9 are formed into an integrated body by various known joining means or methods, e.g., welding, brazing, caulking, adhesion with an adhesive agent, screwing, pressure insertion, or combinations thereof. Of course, the club head 1 may be formed of a single kind of a metallic material.

The thickness T of the face member 8 is not particularly limited. However, if the thickness T is too large, the repulsion property of the head tends to lower, and if the thickness T is too small, the durability tends to lower due to lack of strength. From such points of view, the thickness T of the face member 8 is preferably at least 1.5 mm, more preferably at least 1.8 mm, still more preferably at least 2.0 mm, and it is preferably at most 4.5 mm, more preferably at most 4.0 mm, still more preferably at most 3.0 mm. A plurality of face lines FL for enhancing a frictional force with a ball such as grooves may be disposed at intervals on the face 2, as occasion demands.

As shown in FIGS. 2 and 3, the head body 1A is provided on its back surface side with a cavity C sinking toward a face side and a backward protruding portion 14 which extends annularly to surround the cavity C and protrudes toward the back of the head. The backward protruding portion 14 in this embodiment includes a top side protruding portion 14*a* extending along the top surface 3, a sole side protruding portion 14*b* extending along the sole surface 4, a toe side protruding portion 14*c* extending along the toe surface 5, and a heel side protruding portion 14*d* connecting the top side protruding portion 14*a* and the sole side protruding portion 14*b* on the heel side of the head. These protruding portions 14*a* to 14*d* are formed into an annular shape to enclose a sweet spot SS (shown in FIGS. 1 and 3). The term "sweet spot" SS denotes, as shown in FIG. 3, a point where a perpendicular line drawn to the face 2 from the center of gravity G of the club head 1 intersects the face 2.

A cavity back structure having a backward protruding portion 14 as mentioned above allocates a larger weight to a position separated backward from the face 2 to increase the moment of inertia of the head and, therefore, it is useful in stabilizing the directionality of a hit ball.

As shown in FIG. 3, the sole side protruding portion 14*b* is provided with a back wall portion 21 which extends backward of the head and rises up toward the top of the head at a position away from the back face 6 to form a space 15 between the back wall portion 21 and the back surface of the head body 1A. Such a structure can allocate a still larger weight to a position separated backward on a bottom side of the head 1 to give a deeper and lower center of gravity.

The back wall portion 21 in this embodiment includes a first wall portion 21*a* located on a side near the face 2, and a second wall portion 21*b* located backward of the first wall portion 21*a* to have an approximately step-like cross section. The front surface of each of the first and second wall portions 21*a* and 21*b* is approximately parallel to the face 2. Such a backward protruding portion 14 provides, behind the face member 8, the space 15 which allows the face member 8 to freely bend backward of the head upon hitting a ball and, therefore, it serves to enhance the repulsion property of the club head 1.

Further, as shown in FIG. 2, the back wall portion 21 has, when viewed from the back surface side of the head 1 in the standard state, a toe side protruding portion 14*bt* extending on the toe side of the head, a heel side protruding portion 14*bh* extending on the heel side of the head, and a middle protruding portion 14*bc* having a height smaller than the toe side and heel side protruding portions 14*bt* and 14*bh* and extending between the toe side and heel side protruding portions 14*bt* and 14*bh* through steps located on its both side. In this embodiment, an upper edge 16 of the toe side protruding portion 14*bt* is connected to an upper edge 17 of the middle protruding portion 14*bc* through a toe side inclined edge 19 which extends toward the sole side and is inclined toward the toe side, when viewed from the back surface side. Similarly, an upper edge 18 of the heel side protruding portion 14*bh* is connected to the upper edge 17 of the middle protruding portion 14*bc* through a heel side inclined edge 20 which extends toward the sole side and is inclined toward the heel side. The back wall portion 21 having such a shape is preferred from the viewpoint that a weight is allocated to toe and heel sides of the head to increase the moment of inertia of the head and, therefore, the directionality of a hit ball is stabilized.

As shown in FIGS. 2 to 4, the head body 1A has at least one recess or hole 10 formed in an outer surface 1S of the head body except the face 2. The term "outer surface" 1S as used herein denotes a surface exposed to the outside of a finished club head 1 (i.e., so-called fished surface). Usually, a recess or recesses 10 are formed in the backward protruding portion 14.

In this embodiment shown in the drawings, two recess portions 10 are formed in the backward protruding portion 14. Specifically, the recess portions 10 are formed in the sole side protruding portion 14 so as to open on the back surface side thereof. Preferably, at least two recess portions 10, including a toe side recess 10T formed on the toe side of the sole side protruding portion 14*b* and a heel side recess 10H formed on the heel side of the sole side protruding portion 14*b*, are formed.

Figure 4A:
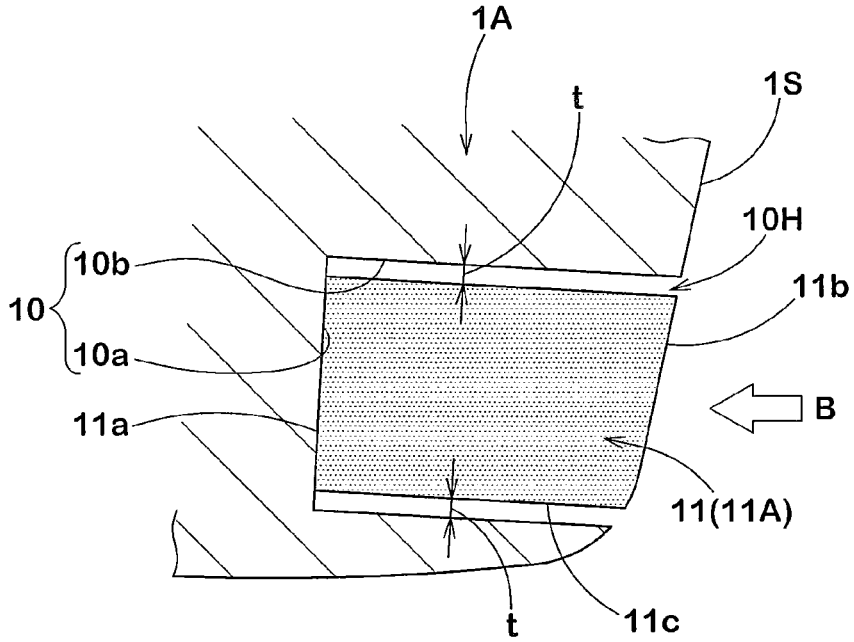
FIG. 4A is a partial enlarged view of FIG. 3.
Figure 4B:
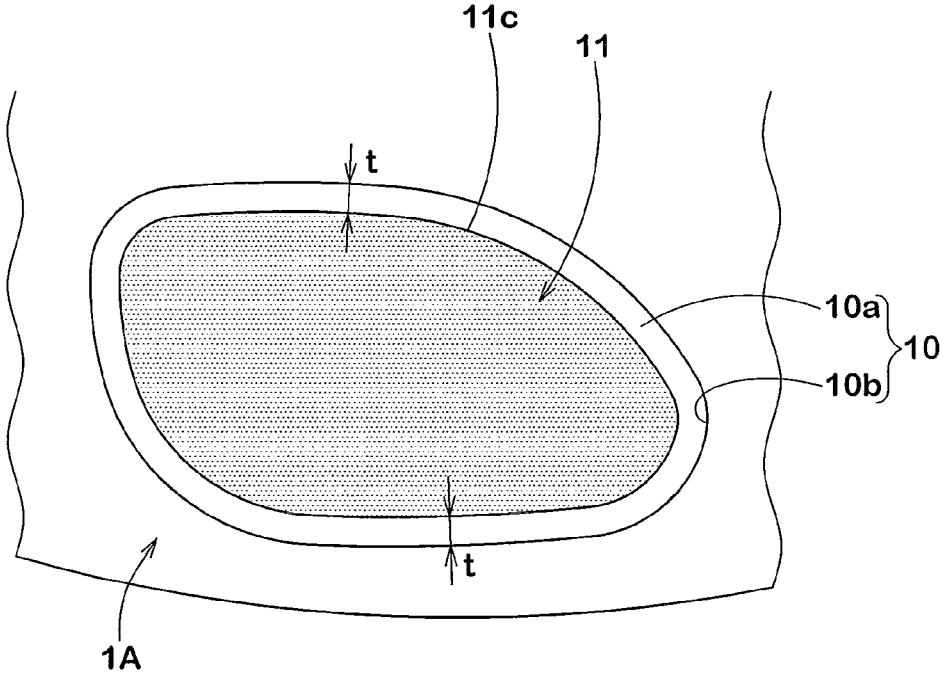
FIG. 4B is a partial back view viewed from "B" in FIG. 4A.

As shown in FIG. 4A, each of the recess portions 10 includes a bottom surface 10*a* located at a position farthest from the outer surface 1S of the head body 1A, and a sidewall surface 10*b* extending from the bottom surface 10*a* to the outer surface 1S. In this embodiment shown in the drawings, the bottom surface 10*a* is formed into a flat surface approximately perpendicular to the horizontal plane HP. The profile of the bottom surface 10*a* is not particularly limited, and it may be for example a shape close to a parallelogram long in a toe-heel direction as shown in FIG. 4B. In this embodiment, the sidewall surface 10*b* extends substantially horizontally, continuously and backward from the edge of the bottom surface 10*a* up to the outer surface 1S. Therefore, the depth direction of the recess 10 substantially conforms to the front-back direction of the head. Although only a heel side recess 10H is shown in FIGS. 4A and 4B, the toe side recess 10T can of course have the same or similar construction.

A vibration absorbing member 11 made of a viscoelastic material is disposed in each recess portion 10. In this embodiment, the vibration absorbing member 11 comprises a toe side vibration absorbing member 11T disposed in the toe side recess portion 10T and a heel side vibration absorbing member 11H disposed in the heel side recess portion 10H.

Each vibration absorbing member 11 is in an approximately columnar shape including an inner end 11*a* which is an end located on a bottom surface 10*a* side of the recess 10, an outer end 11*b* which is an end located on a outer surface 1S side of the head 1, and a side surface 11*c* extending between them. The outer end 11*b* of the vibration absorbing member 11 forms substantially a flat surface with the outer surface 1S of the head body 1A.

As shown in FIG. 4A, the vibration absorbing member 11 is inserted into the recess portion 10 such that only the inner end 11*a* thereof is firmly fixed to the bottom surface 10*a* of the recess portion 10 to have a free vibration portion 11A extending up to the other end 11*b* of the member 11 located at a position corresponding to the outer surface 1S of the head body 1A without coming into contact with the sidewall surface 10*b* of the recess portion 10. The fixing of the vibration absorbing member 11 to the recess portion 10 can be made by various means, e.g., adhesive agent or screwing.

Since only the inner end 11*a* of the vibration absorbing member 11 is fixed to the bottom surface 10*a* of the recess portion 10, the vibration absorbing member 11 is supported at one end thereof by the head body 1A and vibrates easily. Therefore, vibration of the head body 1A generating on hitting a ball is effectively transmitted to the vibration absorbing member 11. The vibration transmitted to the vibration absorbing member 11 is converted to heat by internal friction and efficiently decays. Thus, the golf club head 1 of the present invention can provide a very soft feel of hitting a ball to golfers. Further, since the free vibration portion 11A is physically separated by the head body 1A, vibration of the free vibration portion 11A itself is not transmitted back to the head body 1A and, therefore, a good vibration absorbing action is obtained.

Since the iron-type golf club head 1 has many occasions to hit a golf ball placed directly on a lawn or grass, the sole surface 4 very often comes into contact with the ground. Therefore, if the vibration absorbing member 11 is disposed in the sole surface, there is a risk that the vibration absorbing member 11 is damaged or comes off from the recess portion by contact with the ground. Therefore, it should be avoided to form the recess portion 10 so as to open to the sole surface 4 which faces the ground. From the viewpoint of enhancing the durability of the vibration absorbing member 11, it is preferable to forms the recess portion 10 so as to open on the back surface side of the head 1, whereby the vibration absorbing member 11 is prevented from coming into direct contact with the ground and can be protected over a long term.

Vibration on the sole side of the head 1 generates between the toe and the heel. In particular, in the case of a back wall portion 21 having a larger height at toe and heel sides as shown in FIG. 2, a large vibration is easy to generate on the toe and heel side of the head 1. Therefore, in order to efficiently absorb such a vibration, it is preferable to dispose separately at least two vibration absorbing members on both the toe side and the heel side, as exemplified in this embodiment, thereby absorbing the vibration certainly. In order to certainly exhibit such an action, it is preferable that the toe side vibration absorbing member 11T has a center of gravity Gt on a toe side with respect to a vertical plane VP which, as shown in FIG. 1, passes through the sweet spot SS and is vertical to the face 2, and the heel side vibration absorbing member 11H has a center of gravity Gh on a heel side with respect to the vertical plane VP.

As shown in FIGS. 4A and 4B, the vibration absorbing member 11 in this embodiment is disposed in the recess portion 10 without coming into contact with the sidewall surface 10*b* of the recess portion 10. Thus, a space extending over the full depth of the recess portion 10 is formed around the side surface 11*c* of the absorbing member 11, and the entire of the vibration absorbing member 11 serves as the free vibration portion 11A. In such an embodiment, it is possible to secure maximally the length of the free vibration portion 11A and to expect a more effective vibration absorbing action.

The size of the space between the sidewall surface 10*b* of the recess 10 and the side surface 11*c* of the vibration absorbing member 11 is not particularly limited. However, if the space is too small, there is a tendency that no sufficient vibration absorbing property is obtained, since the free vibration portion 11A of the vibration absorbing member 11 may come into contact with the head body 1 by vibration on impact. If the space is too large, the space is easily clogged with soil or sand and the vibration absorbing property is lowered. From such points of view, it is preferable that the width "t" of the space is at least 0.1 mm, especially at least 0.2 mm, more especially at least 0.3 mm, and it is at most 3.0 mm, especially at most 2.0 mm, more especially at most 1.0 mm. The width "t" of the space denotes a value measured in a direction vertical to the profile of the recess portion 10.

The viscoelastic material for forming the vibration absorbing member 11 includes, for instance, a rubber such as SBR and silicone rubber, a thermoplastic elastomer such as polyether block amide commercially available from Arkema Inc. under the trademark of "PEBAX" and a styrene-based thermoplastic elastomer commercially available from Kuraray under the trademark of "HYBRAR", a blend of the thermoplastic elastomer with another polymer such as a blend of HYBRAR and polypropylene, and a polymer alloy such as a styrene-based thermoplastic elastomer commercially available from Mitsubishi Chemical Corporation under the trademark "RABALON". Typical examples of the viscoelastic material for the vibration absorbing member 11 are, for instance, SBR containing 1.5 parts by weight of sulfur per 100 parts by weight of the rubber (complex modulus of SBR: $5.07\times10^7$ dyn/cm$^2$), SBR containing carbon black (complex modulus of SBR: $3.86\times10^8$ dyn/cm$^2$), PEBAX 5533 made by Arkema Inc. (complex modulus: $2.72\times10^9$ dyn/cm$^2$), nylon 11 (complex modulus: $1.45\times10^{10}$ dyn/cm$^2$), and silicone rubber (complex modulus: $1.41\times10^7$ dyn/cm$^2$). Of these, PEBAX and nylon 11 can be molded by injection molding, and other viscoelastic materials can be molded by press molding.

Although the complex modulus of the vibration absorbing member 11 is not particularly limited, but there is a risk that the vibration absorbing member 11 is hard and the vibration absorbing action on impact tends to lower if the complex modulus is too large, and there is a risk that the vibration absorbing member 11 generates a noise due to excessive vibration if the complex modulus is too small. Therefore, it is preferable that the vibration absorbing member 11 has a complex modulus of at least $2.0\times10^7$ dyn/cm$^2$, especially at least $3.0\times10^7$ dyn/cm$^2$, more especially at least $5.0\times10^7$ dyn/cm$^2$, and it is at most $1.0\times10^{10}$ dyn/cm$^2$, especially at most $6.0\times10^9$ dyn/cm$^2$, more especially at most $3.0\times10^9$ dyn/cm$^2$. The term "complex modulus" as used herein denotes a value measured under the conditions of a measuring temperature of 0 to 10° C. and a frequency of 10 Hz.

Also, the hardness of the vibration absorbing member 11 is not particularly limited. However, if the hardness is too large, the vibration absorbing member 11 tends not to be able to exhibit a sufficient vibration absorbing ability, and if the hardness is too small, the vibration absorbing member 11 is easily damaged and tends to lower the durability. From such points of view, it is preferable that the hardness (JIS A hardness) of the vibration absorbing member 11 is at least 40, especially at least 50, and is at most 90, especially at most 80.

It is preferable that the vibration absorbing member 11 is incorporated with a powder of a metal having a high specific gravity. Such a vibration absorbing member containing a high density metallic powder can be downsized, since a high vibration absorbing property is obtained. Thus, since the vibration absorbing property can be sufficiently secured even if the volume of the recess portion 10 for disposing the vibration absorbing member therein is reduced, the degree of freedom in design of the head body 1A is increased. From the viewpoints of availability and cost of the metal powder, it is preferable that the specific gravity of the metal is at least 7, especially at least 10, and is at most 22, especially at most 20.

Examples of the metal having a specific gravity of 7 or more are, for instance, iron (specific gravity 7.86), cupper (specific gravity 8.92), lead (specific gravity 11.3), nickel (specific gravity 8.85), zinc (specific gravity 7.14), gold (specific gravity 19.3), platinum (specific gravity 21.4), osmium (specific gravity 22.6), iridium (specific gravity 22.4), tantalum (specific gravity 16.7), silver (specific gravity 10.49), chromium (specific gravity 7.19), tungsten (specific gravity 19.3), and alloys containing at least one of these metals such as brass (specific gravity 8.5). Since lead is harmful to humans and since gold and silver are expensive, it is preferable to use alloys containing one or more of tungsten, copper and nickel. The metallic powder is preferably treated with a coupling agent such as a silane coupling agent in order to enhance the affinity or adhesion property to the viscoelastic material.

As to a total volume V of the vibration absorbing members 11 disposed (in case of disposing a single vibration absorbing member, the "total volume V" denotes a volume of the vibration absorbing member, and in case of disposing a plurality of vibration absorbing members, the "total volume V" denotes a sum of volumes of all vibration absorbing members), if the total volume V is too small, the vibration absorbing action tends to be insufficient, and if it is too large, the weight of the vibration absorbing member 11 may become large, so the member 11 is easily come off. Therefore, it is preferable that the total volume V of the vibration absorbing member 11 is at least 0.2 $cm^3$, especially at least 0.3 $cm^3$, more especially at least 0.5 $cm^3$, and it is at most 30 $cm^3$, especially at most 20 $cm^3$, more especially at most 10 $cm^3$.

From the same viewpoints as above, it is preferable that a total weight W of the vibration absorbing members 11 is at least 1.0 g, especially at least 2.0 g, more especially at least 3.0 g, and it is at most 80 g, especially at most 70 g, more especially at most 60 g. In particular, it is preferable that a ratio W/WH of the total weight W of the vibration absorbing member 11 to a whole weight WH of the head 1 is at least 0.004, especially at least 0.008, more especially at least 0.012, and the ratio W/WH is at most 0.32, especially at most 0.28, more especially at most 0.24.

The shape of the vibration absorbing member 11 is not particularly limited. Therefore, the opening of the recess portion 10 can have various shapes such as circle, semicircle, triangle, ellipse, parallelogram, and shapes similar to these shapes. Although the vibration absorbing member 11 may have a conical shape, a pyramid shape such as trigonal pyramid, a spherical shape and other shapes, it is preferable from a production efficiency that the vibration absorbing member 11 has a columnar shape such as a circular column, a triangular prism shape or the like.

An area S1 of the bottom surface 10*a* of the recess portion 10 is not particularly limited and can be set to a desired value. However, if the area S1 is large, the vibration absorbing member 11 becomes large and tends to be easily come off from the recess portion 10, and if it is too small, the vibration absorbing member 11 becomes small and the vibration absorbing action tends to lower. From such points of view, it is preferable that the area S1 of the bottom surface 10*a* is at least 25 $mm^2$, especially at least 50 $mm^2$, more especially at least 80 $mm^2$, and it is at most 400 $mm^2$, especially at most 300 $mm^2$, more especially at most 200 $mm^2$.

From the same viewpoints as above, it is preferable that an area S2 of the sidewall surface 10*b* of the recess portion 10 is at least 100 $mm^2$, especially at least 150 $mm^2$, more especially at least 200 $mm^2$, and it is at most 1,000 $mm^2$, especially at most 700 $mm^2$, more especially at most 500 $mm^2$.

In the case that a plurality of the vibration absorbing members 11 are disposed, it is sufficient that at least one recess portion 10 has the bottom surface 10*a* and the sidewall surface 10*b* which fulfill the conditions mentioned above, but it is preferable that half or more of the vibration absorbing members 11, especially all of the vibration absorbing members 11, fulfill these conditions of the areas S1 and S2. In the case that the number of the vibration absorbing members 11 is odd, the term "half" denotes a whole number obtained by dividing the number of the recess portions by two and rounding the obtained value to the whole number.

Further, it is preferable that a ratio S2/S of the area S2 of the sidewall surface 10*b* of the recess portion 10 to a total inner surface S (i.e., area S1 of the bottom surface+area S2 of the sidewall surface) of the recess portion 10 is at least 0.2, especially at least 0.4, more especially at least 0.6, and it is at most 0.96, especially at most 0.9, more especially at most 0.8. If the ratio S2/S is large, the depth of the recess portion 10 becomes large, so the strength of the head body 1A is tends to lower. If the ratio S2/S is small, the vibration absorbing action on impact tends to lower since the size in the longitudinal direction of the vibration absorbing member 11 is small.

Further, as shown in FIG. 2 viewed from the back of the head 1, a distance L, a distance L between a center of gravity Gt of the toe side vibration absorbing member 11T and a center of gravity Gh of the heel side vibration absorbing member 11H is preferably at least 20 mm, more preferably at least 30 mm, still more preferably at least 50 mm, and it is preferably at most 100 mm, more preferably at most 95 mm, still more preferably at most 90 mm. If the distance L is small, it will be difficult to absorb vibration on the toe side and vibration on the heel side in a balanced manner. If the distance L is large, the vibration absorbing members 11 must be disposed on an upper side of the head from a dimensional restriction in the toe-heel direction of an iron-type club head, so the vibration absorbing effect tends to lower.

Figure 5A:
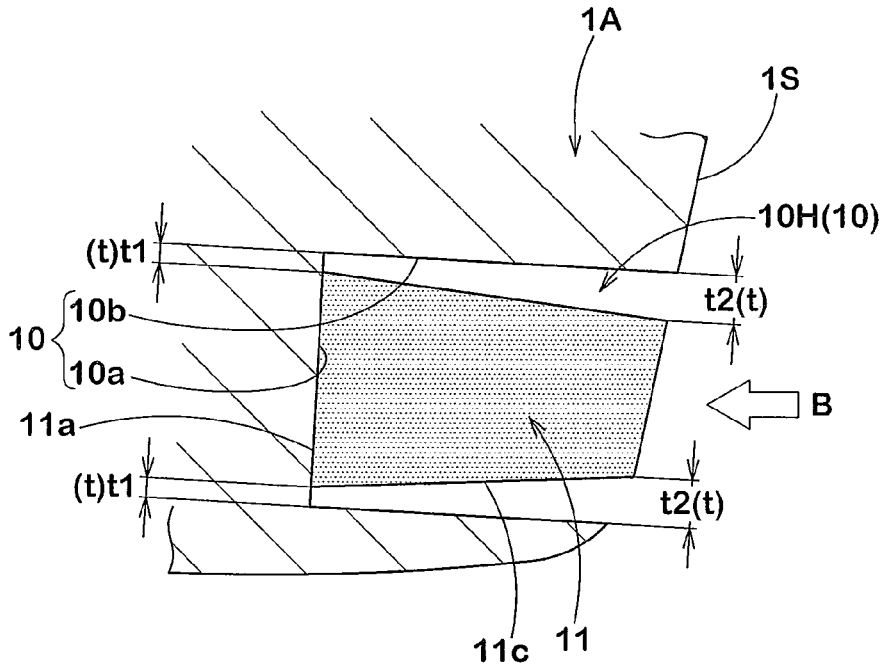
FIGS. 5A and 5B are views showing another embodiment of the present invention.
Figure 5B:
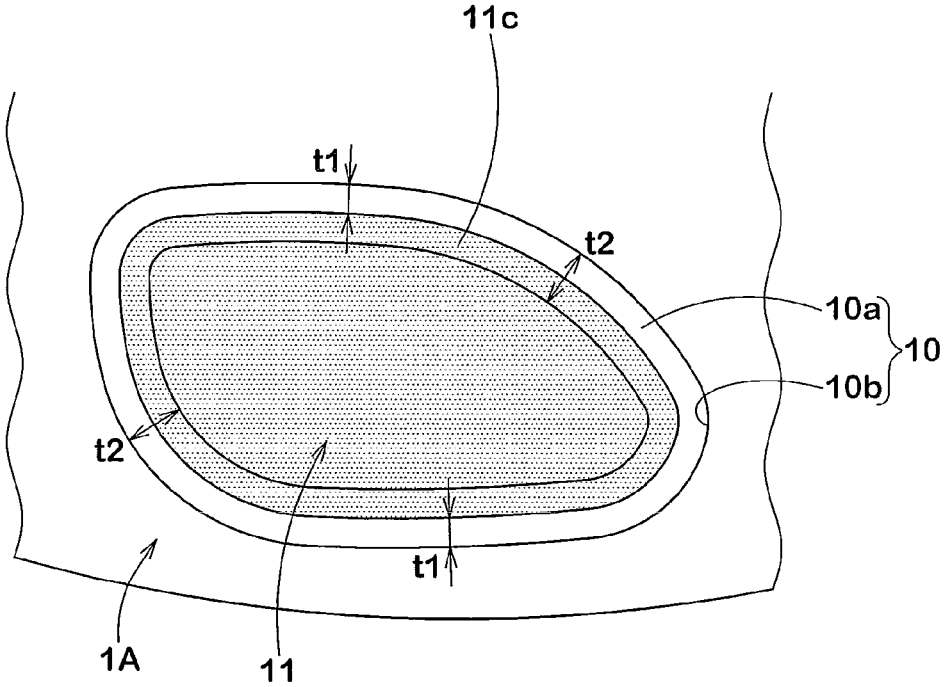

Another embodiment of the present invention is shown in FIGS. 5A and 5B. In this embodiment, a space formed between the sidewall surface 10*b* of the recess portion 10 and the side surface 11*c* of the vibration absorbing member 11 gradually increases from the bottom surface 10*a* side of the recess portion 10 toward the outer surface 1S side of the head body 1A ($t1<t2$). The club head of this embodiment is the same as the club head of the embodiment shown in FIG. 1 except this space having a gradually-increasing width "t".

In general, the free vibration portion 11A of the vibration absorbing member 11 shows a maximum amplitude at its outer end 11*b* when vibrating. Therefore, the vibration absorbing member 11 is prevented from coming into contact with the sidewall surface 10*b* of the recess portion 10 to exhibit an excellent vibration absorbing effect by changing the width "t" of the space as mentioned above, even if the free vibration portion 11A vibrates greatly.

Such a width-changing space may be formed around the vibration absorbing member 11 over the whole circumference thereof as shown in FIG. 5B, but it is sufficient that such a space is formed at least in a direction of vibration which mainly occurs. For example, since the vibration absorbing member 11 in this embodiment has a shape horizontally long in the toe-heel direction, the member 11 is easy to vibrate in an up-and-down direction. Therefore, the above-mentioned effect is sufficiently obtained when upper space and lower space located above and below the vibration absorbing member 11 are changed to have a gradually increasing width "t" as mentioned above.

Figure 6A:
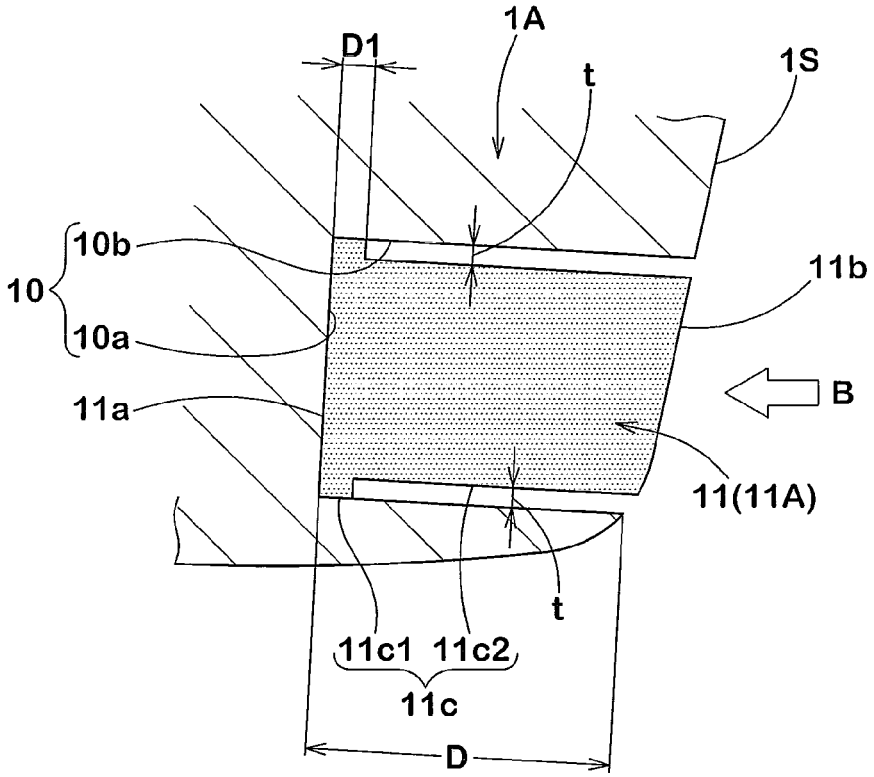
FIGS. 6A and 6B are views showing still another embodiment of the present invention.
Figure 6B:
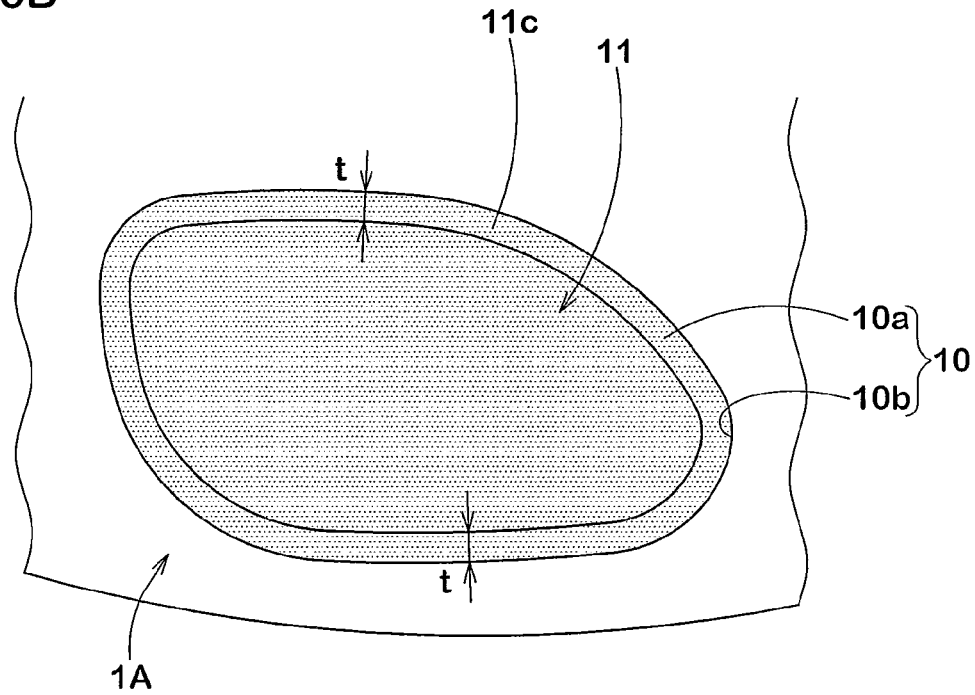

Still another embodiment of the present invention is shown in FIGS. 6A and 6B. The vibration absorbing member 11 in this embodiment comprises, in the standard state of the club head, a fixing portion 11*c*1 where the side surface 11*c* of an end portion on the inner end 11*a* side comes into contact with the sidewall surface 10*b* of the recess portion 10, and a non-fixing portion 11*c*2 separated from the sidewall surface 10*b*. The non-fixing portion 11*c*2 provides the free vibration portion 11A. The club head of this embodiment is the same as the club head of the embodiment shown in FIG. 1 except the vibration absorbing member 11 has such a shape. The vibration absorbing member 11 in this embodiment has an enhanced strength of adhesion to the recess portion 10 whereby the durability may be improved. Moreover, since the vibration absorbing member 11 has the free vibration portion 11A although a part thereof comes into contact with the sidewall surface 11*b* of the recess portion 10, it can sufficiently exhibit the vibration absorbing action.

It is preferred from the viewpoint of enhancing the strength of fixing the vibration absorbing member 11 to the recess portion 10 that a length D1 of the fixing portion 11*c*1 is large, but if the length D1 is too large, the vibration absorption property tends to be deteriorated since the free vibration portion 11A becomes small. Therefore, it is preferable that the length D1 of the fixing portion 11*c*1 measured in the depth direction of the recess portion 10 is at least 10%, especially at least 20%, of a whole depth D of the recess portion 10, and it is at most 60%, especially at most 50%, of the whole depth D. In the case that the length D1 or the whole depth D is not constant, a minimum depth is applied to each of them.

Figure 7:
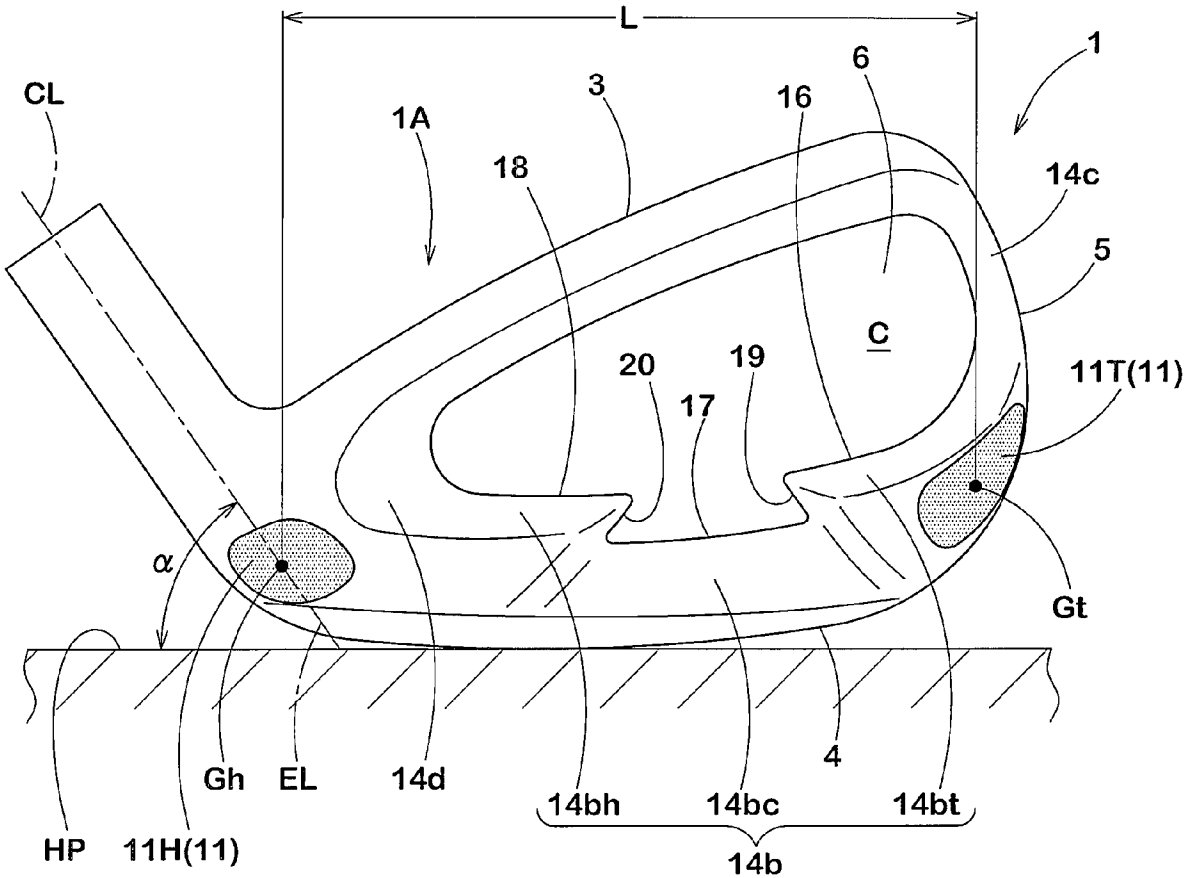
FIG. 7 is a back view of a golf club head showing another embodiment of the present invention.
Figure 8:
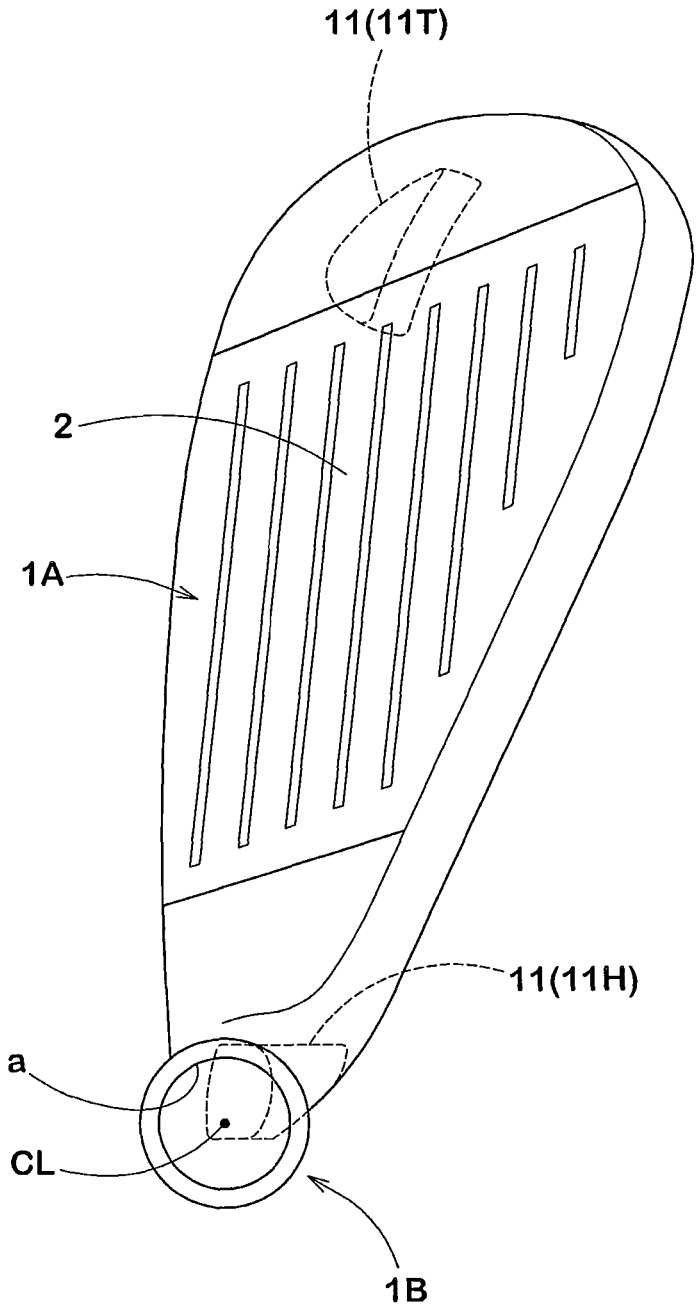
FIG. 8 is a plan view of an iron-type golf club head viewed parallel to an axial center line of a shaft inserting hole of the club head.

Still another embodiment of the present invention is shown in FIGS. 7 and 8. The vibration absorbing member 11 in this embodiment includes a vibration absorbing member disposed at a location at which the member 11H intersects an extended line EL of the center line CL of the shaft inserting hole "a". In FIGS. 7 and 8, the heel side vibration absorbing member 11H is disposed to intersect the extended line EL.

In general, vibration generating at a hitting surface of the face when hitting a ball is transmitted to a hand of a player through the hosel portion 1B, a shaft and a grip. Therefore, the vibration can be efficiently attenuated by disposing the vibration absorbing member 11 on the vibration pass, namely at a location intersecting the extended line EL of the center line CL of the shaft inserting hole "a". In particular, from the viewpoint that vibration is more efficiently absorbed, it is preferable to set the shortest distance between the center of gravity of the vibration absorbing member 11 and the extended line EL to at most 5 mm, especially at most 3 mm.

While preferable embodiments of the present invention have been described with reference to the drawings, it goes without saying that the present invention is not limited to only such embodiments and various changes and modifications may be made. For example, the present invention has been described with reference to an iron-type golf club head, but it goes without saying that the present invention is applicable to various types of club heads such as wood-type, utility-type and putter-type golf club heads as well as iron-type golf club head.

The present invention is more specifically described and explained by means of the following Examples and Comparative Examples. It is to be understood that the present invention is not limited to these Examples.

Examples 1 to 8 and Comparative Examples 1 and 2

Iron-type golf club heads having a loft angle of 24° were produced based on the specifications shown in Table 1 and FIGS. 1 to 4. In each Example, a face-receiving member was produced from SUS 630 by a lost wax precision casting method, and a face member was produced from a Ti-6Al-4V alloy by press molding. The face-receiving member and the face member were firmly fixed to each other by caulking and with an adhesive agent. Toe-side and heel-side vibration absorbing members having shapes as shown in FIG. 2 were produced by injection molding of a polymer alloy (viscoelastic material) commercially available under the trademark "RABALON" SR04 made by Mitsubishi Chemical Corporation. Each vibration absorbing member had substantially the same cross sectional shape as the cross sectional shape of each recess except a space forming portion.

Common specifications are as follows:

Weight of head: 250 g (5-iron club)

Total volume V of vibration absorbing members: 2 $cm^3$

Total weight of vibration absorbing members: 10 g

Means of fixing vibration absorbing members: adhesion

Area S1 of bottom surface of recess: 100 $mm^2$

Area S2 of sidewall surface of recess: 320 $mm^2$

Whole depth D of recess: 10 mm

Ratio S2/(S1+S2): 0.76

Number of vibration absorbing members: 2

The thus produced golf club heads were tested as follows:

<Feel of Hitting Ball and Beauty>

A shaft made of a fiber-reinforced resin (shaft "MP-200" made by SRI Sports Limited, flex R) was attached to each of the club heads to give an iron-type golf club having a club length of 38 inches. Each of five golfers hit twenty three-piece golf balls placed on a lawn with each golf club after conducting bunker shot ten times. The feel of hitting golf balls was evaluated by a five-rating method wherein relative evaluation regarding the hitting feel of the club head of Comparative Example 1 as a standard (3 rating scale) was made. The results are shown by an average value of ten players. The larger the value, the better the feel of hitting ball.

The results are shown in Table 1.

It is observed in Table 1 that the club heads of the Examples according to the present invention can reduce vibration on impact and give a good hitting feel.

TABLE 1

| | Com. Ex. 1 | Com. Ex. 2 | Ex. 1 | Ex. 2 | Ex. 3 | Ex. 4 | Ex. 5 | Ex. 6 | Ex. 7 | Ex. 8 |
|---|---|---|---|---|---|---|---|---|---|---|
| Location of vibration absorbing members | FIG. 2 | FIG. 7 | FIG. 2 | FIG. 7 | FIG. 7 | FIG. 7 | FIG. 7 | FIG. 7 | FIG. 7 | FIG. 7 |
| Sectional shape of vibration absorbing members | FIG. 4 | FIG. 4 | FIG. 4 | FIG. 4 | FIG. 4 | FIG. 4 | FIG. 4 | FIG. 5 | FIG. 6 | FIG. 6 |
| Width "t" of space between vibration absorbing member and sidewall surface of recess (mm) | 0 | 0 | 1 | 0.3 | 1 | 3 | 4 | 1 & 2 | 1 | 1 |
| Ratio D1/D of length D1 of fixing portion to whole depth D of recess | — | — | — | — | — | — | — | — | 30% | 60% |
| Distance L between centers of gravity of toe-side and heel-side vibration absorbing members (mm) | 75 | 90 | 75 | 90 | 90 | 90 | 90 | 90 | 90 | 90 |
| Hitting feel (1-5 ratings) | 3 | 3 | 4.5 | 4.7 | 5 | 4.4 | 3.9 | 5 | 4.4 | 3.6 |

* Values "t" in Example 6 show the maximum and minimum values.

What is claimed is:

1. A golf club head comprising a head body having a face for hitting a ball on a front side of the head body and at least one recess portion in an outer surface of the head body excluding said face, the recess portion having a bottom surface and a sidewall surface extending from the bottom surface to said outer surface of the head body, and at least one vibration absorbing member made of a viscoelastic material and inserted in said at least one recess portion, wherein the head body is provided on its back side with a cavity and a backward protruding portion extending annularly around the cavity, the backward protruding portion is provided on the sole side of the cavity with said at least one recess portion so as to open in the back surface thereof and so that the depth direction of the recess portion substantially conforms to the front-back direction of the head, the vibration absorbing member inserted in the recess portion has a front end fixed to the bottom surface of the recess portion, a rear end located at a position corresponding to said outer surface of the head body in the backward protruding portion, and a side surface extending from the front end to the rear end, the side surface comprises a fixing portion extending for a small distance D1 from the front end toward the rear end and coming into contact with the sidewall surface of the recess portion and a non-fixing portion extending from the fixing portion to the rear end without coming into contact with the sidewall surface of the recess portion to define a constant space in a range of from 0.1 to 3 mm between the sidewall surface and the non-fixing portion of the side surface, the constant space is formed all around the non-fixing portion of the side surface and the rear end of the vibration absorbing member is exposed to the outside of the club head so as to form a part of the outer surface of the golf club head, whereby said constant space of 0.1 to 3 mm is opened in the outer surface of the golf club head so as to surround the rear end of the vibration absorbing member, wherein said head body is an iron-type, said at least one recess portion includes a toe side recess portion formed on a toe side of said head and a heel side recess portion formed on a heel side of said head, said at least one vibration absorbing member includes a toe side vibration absorbing member disposed in said toe side recess portion and a heel side vibration absorbing member disposed in said heel side recess portion, said toe side vibration absorbing member has a center of gravity on a toe side with respect to a vertical plane VP which passes through a sweet spot normal to said face, and said heel side vibration absorbing member has a center of gravity on a heel side with respect to said vertical plane VP.

2. The golf club head of claim 1, wherein said head body is provided on a heel side of the head with a hosel portion having a shaft inserting hole for inserting a shaft, and an extended line of a center line of the shaft inserting hole intersects with said at least one vibration absorbing member.

3. The golf club head of claim 1, wherein a distance L between the center of gravity of said toe side vibration absorbing member and the center of gravity of said heel side vibration absorbing member is from 20 to 100 mm.

4. The golf club head of claim 1, wherein a total volume V of said at least one vibration absorbing member is from 0.2 to 30 $cm^3$.

5. The golf club head of claim 1, wherein a total weight of said at least one vibration absorbing member is from 0.004 to 0.32 times a whole weight of said head.

6. The golf club head of claim 1, wherein said vibration absorbing member has a complex modulus of $2.0 \times 10^7$ to $1.0 \times 10^{10}$ dyn/$cm^2$, measured at a measuring temperature of 0 to 10° C. and a frequency of 10 Hz.

7. The golf club head of claim 1, wherein said vibration absorbing member is incorporated with a powder of a metal having a specific gravity of at least 7.

8. The golf club head of claim 1, wherein a ratio S2/S of an area S2 of said sidewall surface of said recess portion to an area S of a whole inner surface of said recess portion is from 0.2 to 0.96.

9. The golf club head of claim 1, wherein said bottom surface of said recess portion has an area S1 of 25 to 400 $mm^2$.

10. The golf club head of claim 1, wherein the space formed between said sidewall surface of said recess portion and a side surface of said vibration absorbing member is gradually increased from a bottom surface side of said recess portion toward an outer surface side of said head body.

11. The golf club head of claim 1, wherein said small distance D1 is at least 10% and at most 50% of a minimum depth of the recess portion.

12. A golf club head which comprises:

a face member having a top surface and a sole surface, a sole side protruding portion extending rearward from the face member and along the sole surface, at least one recess portion disposed in the sole side protruding portion, said recess portion having a bottom surface facing the face member, and side wall surfaces which extend rearward from the bottom surface, defining said recess which terminates with the termination of the rearwardly extending sole side protruding portion, at least one vibration absorbing member disposed in said at least one recess portion, said vibration absorbing member having a fixing portion fixed at one end to the bottom surface of the recess portion, and fixed to the side wall surfaces of the recess portion for a distance of 10 to 50% of the length of the recess portion and terminating as a free end with the termination of the rearwardly extending sole side protruding portion.

13. The golf club head of claim 12, wherein the vibration absorbing member is made of a viscoelastic material.

14. The golf club head of claim 12, wherein a space of 0.1 to 3 mm is disposed between the side wall surfaces of the recess portion and the vibration absorbing member.

15. The golf club head of claim 12, wherein a recess portion containing the vibration absorbing member is provided in both a toe side and a heel side of the sole side protruding portion.

* * * * *